United States Patent [19]

Braginetz

[11] Patent Number: 4,527,375

[45] Date of Patent: Jul. 9, 1985

[54] DECK BOARD ANCHOR BRACKET

[75] Inventor: Paul A. Braginetz, Staunton, Va.

[73] Assignees: B. P. Fishburne, Jr., Washington, D.C.; Marlin G. Wilson, Staunton, Va.

[21] Appl. No.: 556,937

[22] Filed: Dec. 1, 1983

[51] Int. Cl.[3] ..... E04B 1/38

[52] U.S. Cl. ..... 52/712; 52/665; 403/232.1

[58] Field of Search ..... 52/712, 714, 665, 485; 403/232.1, 394

[56] References Cited

U.S. PATENT DOCUMENTS

| | | | |
|---|---|---|---|
| 3,203,148 | 8/1965 | White | 52/485 |
| 3,989,398 | 11/1976 | Wendt | 403/232.1 |
| 4,022,537 | 5/1977 | Gilb et al. | 52/665 |
| 4,047,352 | 9/1977 | Sweet | 52/712 |
| 4,114,861 | 9/1978 | Long | 403/232.1 |

FOREIGN PATENT DOCUMENTS

| | | | |
|---|---|---|---|
| 1004557 | 3/1983 | U.S.S.R. | 52/714 |

*Primary Examiner*—J. Karl Bell

*Attorney, Agent, or Firm*—B. P. Fishburne, Jr.

[57] ABSTRACT

To deal with the annoying problem of deck board rot and warping, an anchor bracket is provided for installation in newly constructed decks to resist warping or in existing decks where warping has already occured to rectify the situation. The bracket includes a plate body portion which transversely spans abutting end portions of deck boards, and a pair of depending bifurcated extensions on each end of the plate body portion which straddle the underlying support beams or joists of the deck structure and are anchored thereto by nailing. Several embodiments of the bracket are disclosed.

7 Claims, 13 Drawing Figures

DECK BOARD ANCHOR BRACKET

BACKGROUND OF THE INVENTION

Wooden decks, after lengthy periods of exposure to the elements, have a tendency for the deck surface boards to warp to such an extent that end portions of the deck boards will actually separate themselves from underlying support beams and rise considerably above the normal top surface of the deck. This tendency is aggrevated by gradual rotting of the wood near the ends of the deck boards and in the top faces of the support beams which are in contact with the bottom of the deck boards and receive deck board anchor nails in the traditional construction method. The problem creates a very unsightly condition in wood decks and also creates a safety hazard in that walkers on the deck can easily trip over the upwardly curled ends of warped deck boards.

The standard method of repairing the above damage to wooden decks is to replace the affected deck boards with new ones and also to replace as many of the underlying beams or timbers as is necessary, depending upon the degree of rotting which has occurred. This installation of new wood in the deck under traditional repair procedures is required so that deck board anchor nails will remain in place. The standard repair procedure is very costly, and in cases where large numbers of deck boards are involved, can approach the total cost of building a new deck.

A careful study of the problem has revealed that, even in cases where large numbers of deck boards have separated or are about to separate from the deck support beams, most of the wood (more than 90%) in the deck structure is still sound and unrotted. The rotting tends to occur only in the regions where the abutting deck boards rest on the support beams or timbers, which is the area where deck board nails are installed.

The seeking of a means to repair deck damage of the above type without the great expense of installing new deck boards and support timbers has resulted in the development of the present invention, which has for its main objective to successfully deal with the problem with minimal expense.

Another objective of the invention is to provide a device for repairing damage to wooden decks of the above-identified type, which device is in the nature of an anchor bracket of simplified and unitary construction which can readily be installed at necessary locations on the deck by the homeowner with requiring skill.

A further object is to provide a deck board anchor bracket for use in newly-constructed decks, which actually simplifies the construction procedure and substantially eliminates the occurrence of deck board deterioration of the above-mentioned type caused by weathering over a period of time. The use of the anchor bracket in newly-constructed decks in conjunction with traditional deck board nailing, or in lieu thereof, greatly extends the useful life of the deck structure, without the necessity for periodic costly repairs.

Another object of the invention is to provide a deck board anchor bracket which, in one preferred embodiment thereof, also serves as a gage for the uniform parallel lateral spacing of deck boards as the latter are being installed.

Still another object is to provide a bracket of the above-mentioned type which is practical and economical to manufacture, involving a minimum amount of scrap in the manufacturing process.

Other objects and advantages of the invention will become apparent to those skilled in the art during the course of the following description.

DETAILED DESCRIPTION

Figure 1A:
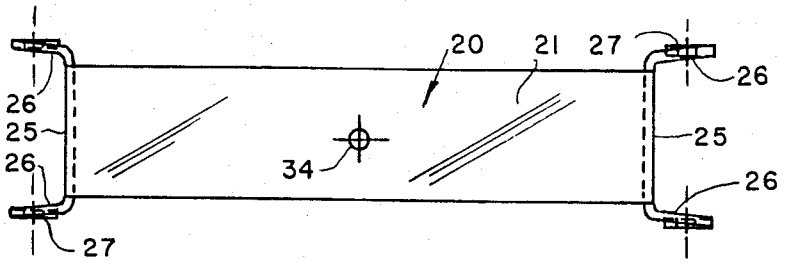
FIG. 1A is a plan view of the bracket in FIG. 1.

Referring to the drawings in detail, wherein like numerals designate like parts, a deck board anchor bracket for use in the repair of wooden decks and in the construction of new decks is depicted in a preferred form in FIGS. 1 through 3, 10 and 11. The bracket 20, which is preferably formed of steel, comprises an elongated flat plate body portion 21 of a length to span transversely the abutting end portions of two adjacent deck boards 22, FIG. 3, below which is a supporting beam or timber 23 also extending transversely of the deck boards, directly beneath their meeting end faces 24.

At its ends, the plate body portion 21 carries depending right angular relatively short plate extensions 25, each carrying a pair of further right angular extensions 26 defining a yoke structure at each end of the deck board anchor bracket. The extensions 26 extend outwardly from the adjacent longitudinal side faces of the deck boards 22, at right angles thereto.

The yoke extensions 26 carry elongated depending anchor arms 27, each of which is preferably provided with a pair of spaced apertures 28 for nails 29 serving to securely attached the arms 27 to the opposite vertical faces of the deck board support timber 23. The bracket 20 secured by eight nails 29 through the arms 27 can serve efficiently as the sole means of securing the deck boards 22 to support timbers 23. If desired, however, additional nails can be driven downwardly through the abutting end portions of the deck boards 22 and into the tops of the timbers 23 in the conventional manner before the anchor bracket 20 is installed.

It may be seen that the elements 21 and 25 form a rather long U-shaped body portion of the bracket. The elements 25 and 26 form U-shaped yokes, as stated, at the two ends of the long body portion. The anchor arms 27 extend in spaced parallel relationship from yoke elements 26 and lie in planes perpendicular to elements 21 and 25.

Figure 1:
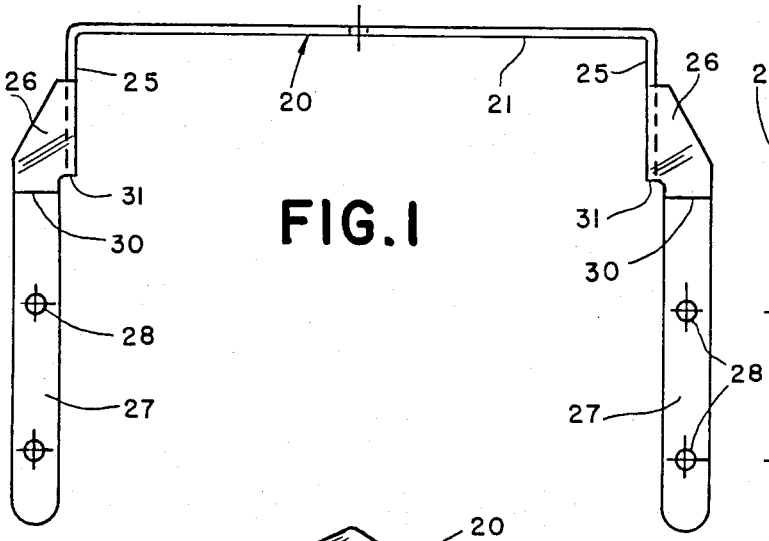
FIG. 1 is a side elevation of a deck board anchor bracket according to one preferred embodiment of the invention.
Figure 1B:
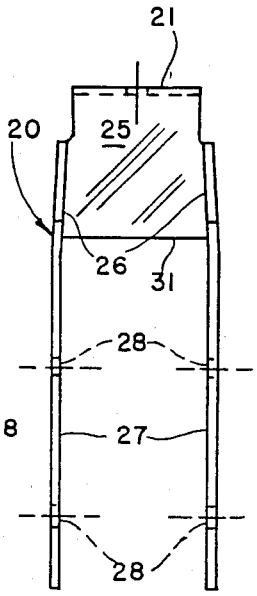
FIG. 1B is an end elevation of the bracket.
Figure 2:
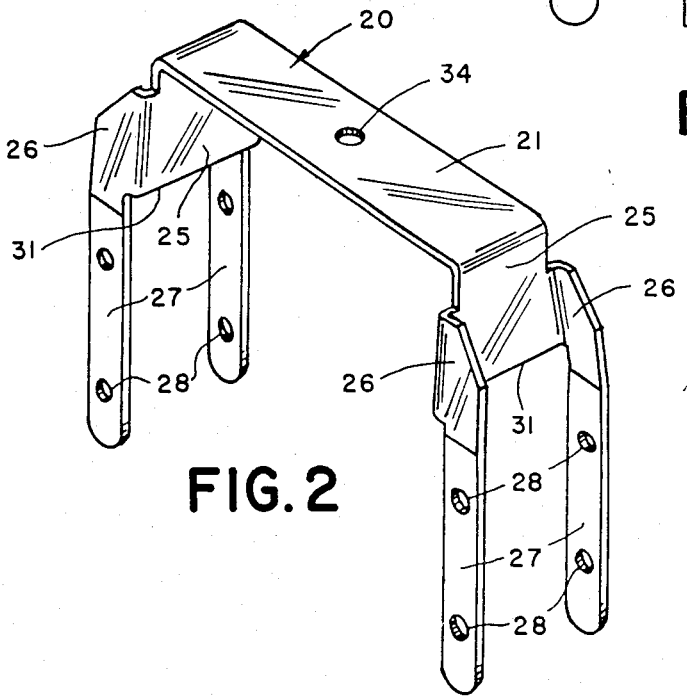
FIG. 2 is a perspective view of the bracket.
Figure 3:
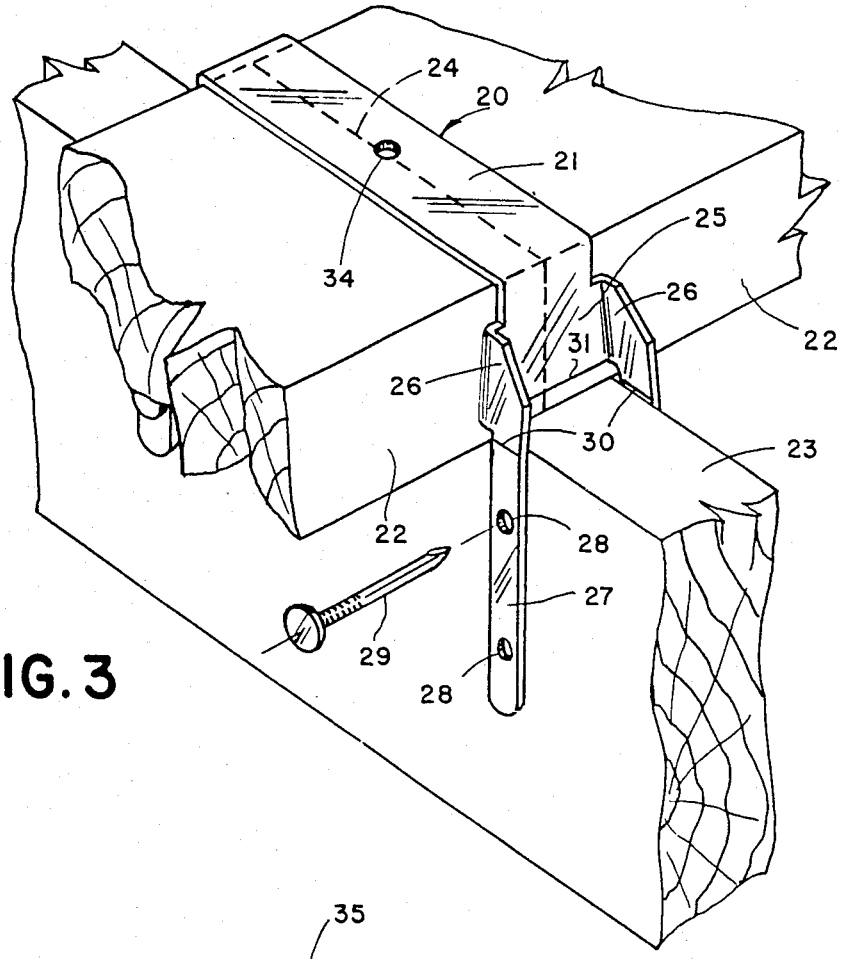
FIG. 3 is a further perspective view of the bracket depicting its installation in a deck structure.

FIGS. 1 through 3 depict the bracket 20 in the installed state, where the arms 27 are drawn inwardly into parallelism with the side faces of the timber 23 by nailing. This produces bend lines 30 at the bottoms of the extensions 26.

Figure 11:
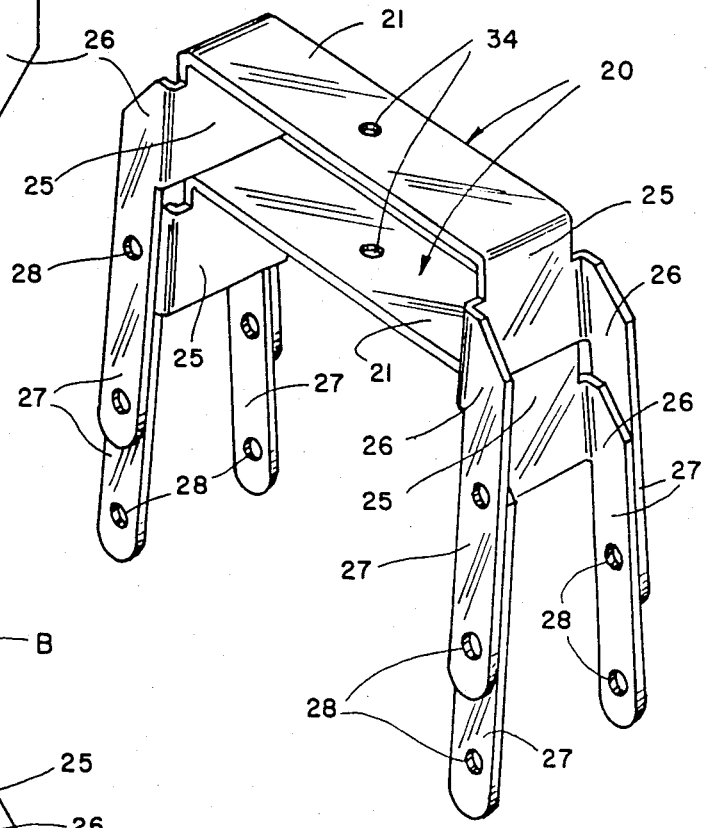
FIG. 11 is a perspective view of brackets of the type shown in FIGS. 1–3 in nested relationship for packaging or storage prior to installation.

Referring to FIG. 11, stacked or nested brackets 20 are depicted prior to installation, and it can be seen that the arms 27 are somewhat divergent toward their free ends to allow nesting for compact storage and packaging. This slight divergency of the arms 27 also facilitates engaging the arms over the tops of the timbers 23 without interference.

As shown in FIG. 3, the lower edges 31 of vertical plate extensions 25 terminate above the lower faces of deck boards 22. This spacing is to enable the bracket 20 to adapt itself without difficulty to deck boards of different thicknesses over a customary range of thicknesses.

Another useful feature of the invention as disclosed in FIGS. 1–3 is that the yoke extensions 26 which project outwardly from the opposite side faces of the deck boards 22 form precision gage elements which establish the uniform spacing of deck boards in the construction of a new deck in which the brackets 20 are employed to secure the deck boards to their support beams 23. The extensions 26 are sized to establish a customary spacing between deck boards, such as about one-half inch.

Figure 10:
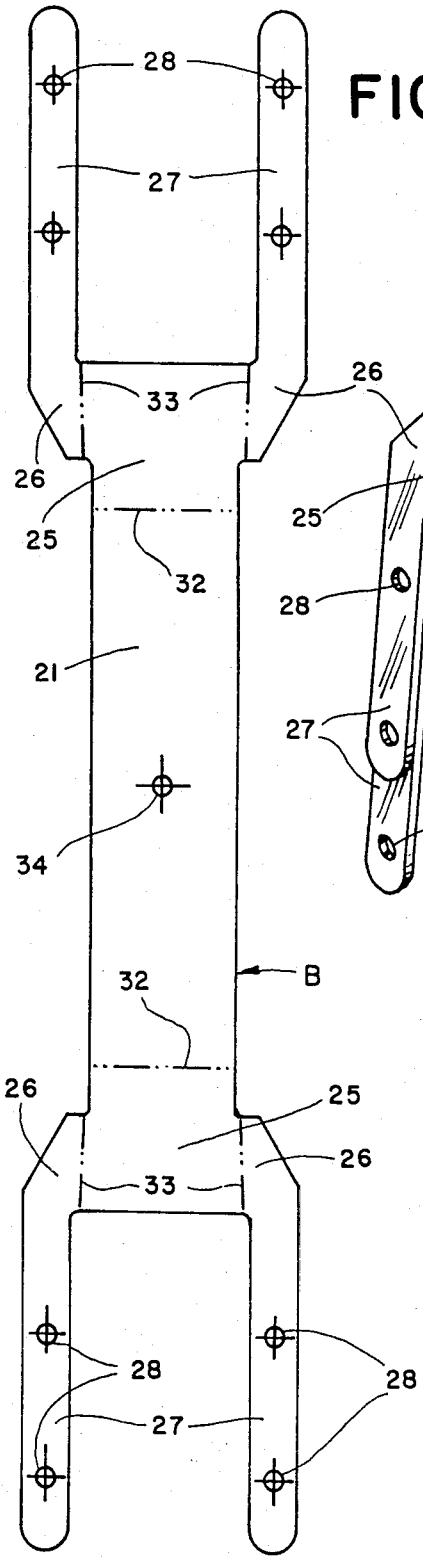
FIG. 10 is a plan view of a blank used in the construction of the bracket shown in FIGS. 1–3.

FIG. 10 shows a flat metal blank B used to construct the anchor bracket 20. This blank includes parallel transverse bend lines 32 to enable the formation of the right angular extensions 25, and pairs of divergent longitudinal bend lines 33 which enable the formation of the yoke extensions 26. The central opening 34 in the blank is simply a locator opening used in the process of manufacturing the bracket. If desired, a nail can be installed through this opening, FIG. 3, to protect the deck board joint from rain water.

Figure 4:
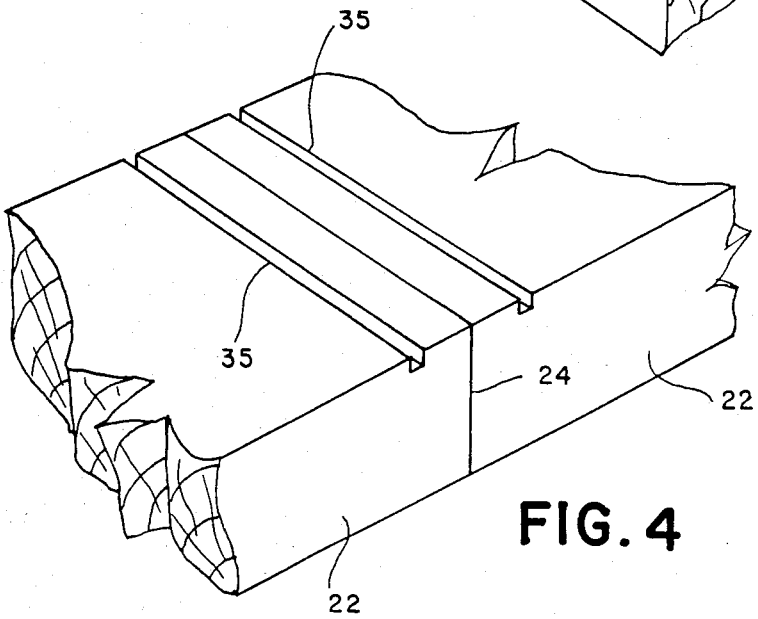
FIG. 4 is a fragmentary perspective view of adjacent deck boards.
Figure 5:
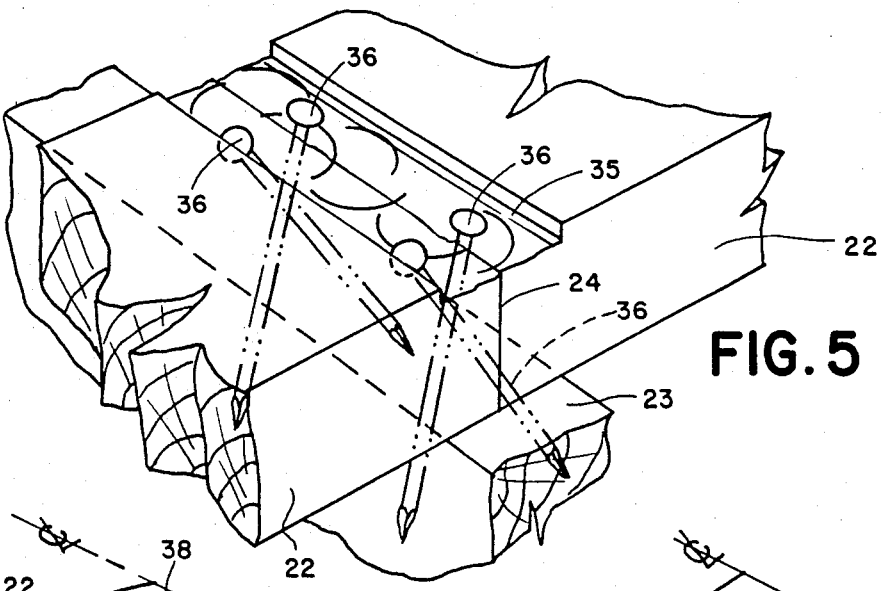
FIG. 5 is a further perspective view of the deck boards following a compressive treatment and installation of anchoring nails.

An optional expedient in the bracket installation process is shown in FIGS. 4 and 5. Two parallel saw cuts 35 can be made across the deck boards 22 near their meeting end faces 24. The wood between these saw cuts can be pounded down with hammer blows, FIG. 5, to a level flush with the bottoms of the two saw cuts 35. This compression and densification of the wood increases its resistance to moisture penetration. Nails 36 can then be installed in a traditional manner through the compressed top faces of the deck boards to anchor them to the beam or timber 23 before the bracket 20 is installed, as previously described. As stated, the nails 36 can be omitted, in which case the bracket 20 serves adequately to anchor the deck boards 22 to the timbers 23 and resist any subsequent rising of the deck board ends due to rotting and/or warping. In fully appreciating the effectiveness of the bracket 20 in permanently securing deck boards to their supporting timbers, regardless of warping tendencies and localized rotting around nails at the ends of the deck boards, it must be realized that in practice the warping deck boards can pull the nails 36 out of the underlying timbers 23, or, in case of rot, the meeting end portions of deck boards can rise and strip themselves completely from the nails. The deck board anchor bracket according to the invention will effectively resist all of this in either new decks or existing decks that have undergone localized deterioration, thus avoiding the necessity for major cost deck reconstruction.

Figure 6:
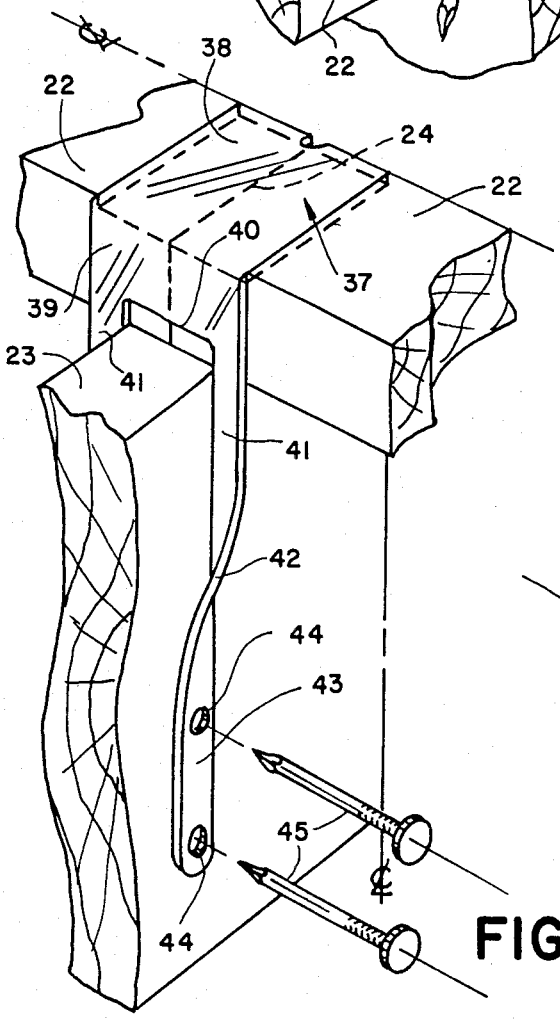
FIG. 6 is a fragmentary perspective view showing a second embodiment of the deck board anchor bracket according to the invention.

FIG. 6 depicts another embodiment of the invention in the form of an anchor bracket 37 having a flat top plate body portion 38 similar to the plate body portion 21. In FIG. 6, the plate body portion 38 is shown seated in the recess produced by the hammering of the wood described in FIGS. 4 and 5. The plate body portion 38 is flush with the top faces of the two deck boards 22.

At its opposite ends, the plate body portion 38 carries downturned perpendicular short extensions 39 whose lower edges 40 terminate above the bottom faces of the deck boards to enable deck board thickness variations.

In lieu of the right angular extensions 26 carrying the arms 27 in the previous embodiment, parallel arms 41 in the same vertical plane with extension 39 descend therefrom to elevations well below the deck boards 22, where the arms are twisted ninety degrees at 42, to provide parallel arm extensions 43 having apertures 44 which receive nails 45. The apertured arm extensions 43 straddle the deck support timber 23, and, if desired, the bracket 37 can be the sole means of permanently and immovably securing deck boards to underlying beams or timbers, without additional nailing.

The bracket 37 cannot serve like the bracket 20 as a spacing gage for parallel deck boards, but does enable deck boards to be spaced more closely should this be desired.

Figure 7:
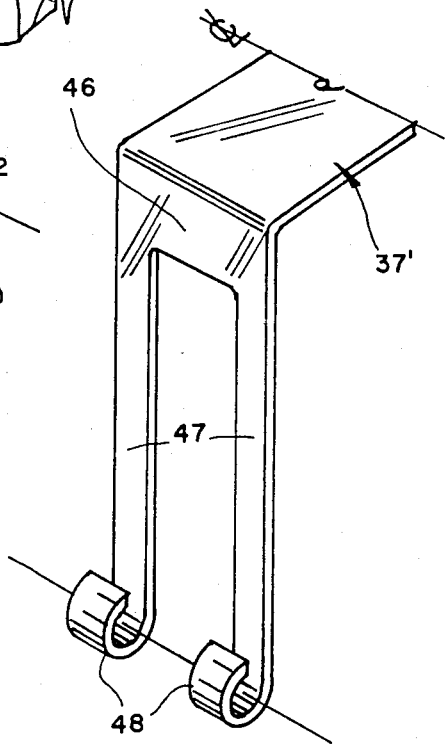
FIG. 7 is a fragmentary perspective view showing a further modification of the bracket.

FIG. 7 depicts a bracket 37' which is a variant of the bracket 37. It includes a corresponding depending short extension 46 carrying attaching arms 47 in a common vertical plane with the extension 46. In lieu of twisting the arms 47, curled knuckles 48 are formed on their ends to receive the nails 45 for attaching the bracket to the timber 23.

Figure 8:
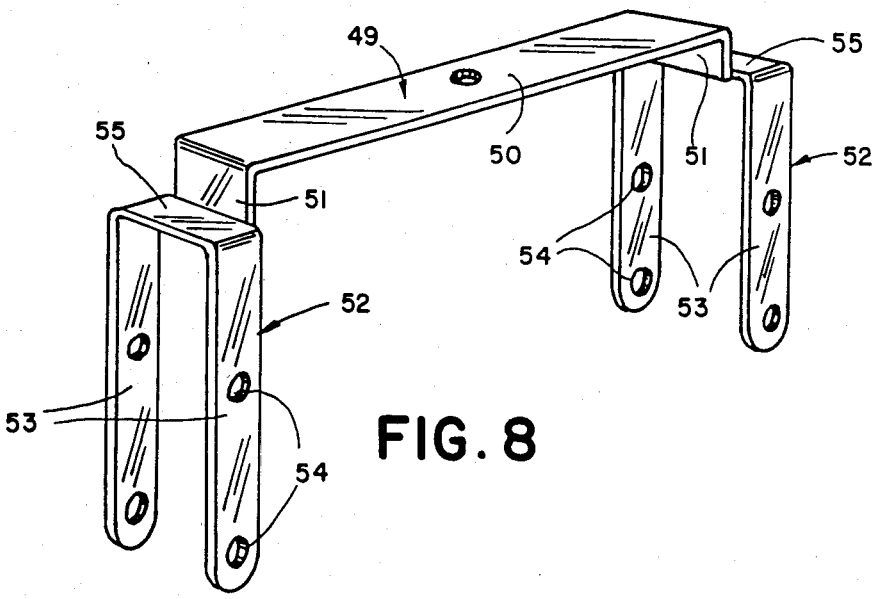
FIG. 8 is a perspective view of a deck board anchor bracket according to a further embodiment of the invention.
Figure 9:
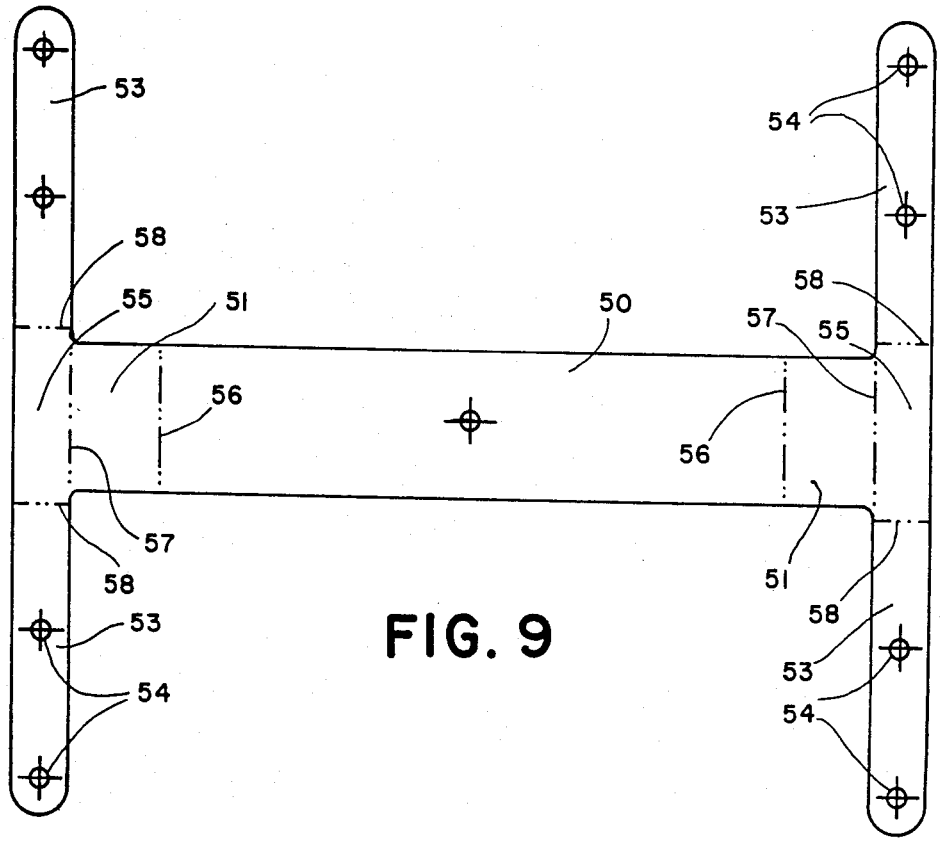
FIG. 9 is a plan view of a metal blank used in the construction of the bracket in FIG. 8.

FIGS. 8 and 9 show another embodiment of the invention in which the deck board anchor bracket 49 has an elongated flat plate body portion 50 provided at its opposite ends with short downturned extensions 51 in turn carrying inverted U-shaped timber straddling yokes 52 each having a pair of spaced parallel arms 53 provided with nail receiving apertures 54. At their tops, the arms 53 are connected by bights 55 perpendicular to the extensions 51 and projecting outwardly thereof and secured thereto in parallel relationship to plate body portion 50.

The bracket 49 is constructed from the blank shown in FIG. 9, and this blank is essentially H-shaped and includes bend lines 56 on which the vertical extensions 51 are formed and parallel bend lines 57 on which the bights 55 are formed. Additional bend lines 58 perpendicular to the bend lines 56 and 57 enable the formation of the parallel arms 53.

While the bracket 49 possesses essentially the same advantages as the bracket 20, considerably more scrap metal is produced in the formation of the blank shown in FIG. 9, in comparison to the blank shown in FIG. 10 where relatively little scrap is developed.

It may now be seen that essentially the invention comprises a unitary bracket for connecting or joining two members, such as a board and supporting timber, disposed in perpendicular planes and crossing each other at right angles. The bracket includes a plate body portion to span one of the members transversely at right angles to its axis and a pair of parallel bifurcated attachment parts or yokes at the opposite ends of the plate body portion and extending at right angles thereto. The bifurcated attachment parts include arms which straddle a timber or the like and are anchored thereto for holding a board or the like in connected fixed relationship to the timber which it crosses.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A bracket formed from a unitary piece of material comprising an elongated flat plate body portion, opposite end substantially perpendicular comparatively short plate extensions on said body portion extending beyond one face thereof only, and a pair of anchor arms for the bracket on each end thereof and being comparatively narrow and elongated in planes which are substantially perpendicular to the planes occupied by the plate body portion and said plate extensions, said arms being joined near corresponding ends thereof to opposite edge portions of the plate extensions and said corresponding ends of the arms being spaced from the plate body portion in the direction which the plate extensions extend away from the plate body portion, the arms of each pair being in spaced laterally opposing generally parallel relationship near and outwardly of the opposite longitudinal edges of the plate body portion, and the arms having free ends spaced substantial distances away from the plate body portion and away from the ends of the plate extensions, the arms forming with the plate extensions substantially U-shaped yokes which are arranged in back-to-back spaced relationship at the ends of the plate body portion.

2. A bracket formed from a unitary piece of material as defined in claim 1, and the arms of each pair being slightly divergent toward their free ends to facilitate the nesting of the bracket with other like brackets.

3. A bracket formed from a unitary piece of material as defined in claim 2, and each of the arms being provided with spaced apertures along its length to facilitate attaching the bracket to a structure.

4. A bracket formed from a unitary section of plate stock having a uniform thickness, said bracket comprising a substantially U-shaped body portion including an elongated flat plate section and attached opposite end substantially right angular plate extensions of lesser length than the elongated plate section and projecting beyond one face of the elongated plate section, and pairs of substantially flat substantially parallel elongated bracket anchor arms attached to opposite side edges of the plate extensions and lying in planes which are substantially perpendicular to planes occupied by the plate extensions, said arms projecting beyond corresponding faces of the plate extensions in directions away from the ends of the elongated plate section, and the arms extending lengthwise for substantial equal distances beyond free edges of the plate extensions and away from the plane occupied by the elongated plate section.

5. A bracket as defined in claim 4, and said arms being apertured.

6. A bracket as defined in claim 5, and said arms being somewhat divergent toward their free ends in the major planes of the arms which are substantially perpendicular to the planes occupied by the plate extensions.

7. A bracket as defined in claim 4, and corresponding edge portions of said arms adjacent to corresponding ends of the arms being joined to the opposite longitudinal edges of the plate extensions along major portions of the lengths of the plate extensions.

* * * * *